United States Patent [19]

White

[11] 3,947,611

[45] Mar. 30, 1976

[54] METHOD OF MAKING A BONDABLE LOW FRICTION THREAD

[76] Inventor: Charles S. White, 35815 42nd St., East, Palmdale, Calif. 93550

[22] Filed: Oct. 29, 1974

[21] Appl. No.: 518,567

Related U.S. Application Data

[60] Division of Ser. No. 317,111, Dec. 21, 1972, abandoned, which is a continuation-in-part of Ser. No. 76,110, Sept. 28, 1970, abandoned.

[52] U.S. Cl. ..... 427/177; 427/365; 427/369; 427/371; 427/305; 427/392; 427/434; 427/439

[51] Int. Cl.[2] ..... B65H 49/00; B65H 54/02

[58] Field of Search ..... 117/115, 65.2, 71 R; 427/177, 434, 385, 392, 439, 369, 365, 371

[56] References Cited

UNITED STATES PATENTS

| | | | |
|---|---|---|---|
| 2,589,034 | 3/1952 | Beedy | 427/13 |
| 2,898,228 | 8/1959 | Kelley | 428/443 |
| 2,953,418 | 9/1960 | Runton et al. | 266/201 |
| 3,000,076 | 9/1961 | Runton et al. | 308/238 |
| 3,030,248 | 4/1962 | Runton et al. | 16/178 |
| 3,037,893 | 6/1962 | White | 248/29 |
| 3,069,283 | 12/1962 | Coleman | 427/41 |
| 3,084,087 | 4/1963 | Weil et al. | 156/166 |
| 3,131,979 | 5/1964 | Shobert | 308/238 |
| 3,167,308 | 1/1965 | Bernstein et al. | 267/156 |
| 3,170,811 | 2/1965 | Sands | 128/421 |

FOREIGN PATENTS OR APPLICATIONS

| | | |
|---|---|---|
| 1,233,103 | 5/1971 | United Kingdom |

*Primary Examiner*—Cameron K. Weiffenbach
*Attorney, Agent, or Firm*—Burton and Parker

[57] ABSTRACT

In the preparation of low friction thread for use in the manufacture of bearings the thread is first rendered bondable, is then coated in a bath of bonding resin, is led vertically out of the bath and the resin is cured to the B-stage, and the B-stage thread is wound into spools for subsequent use.

10 Claims, 3 Drawing Figures

METHOD OF MAKING A BONDABLE LOW FRICTION THREAD

CROSS-REFERENCES TO RELATED APPLICATIONS

This application is a division of application Ser. No. 317,111, filed Dec. 21, 1972, now abandoned which is a continuation-in-part application of my earlier filed application Ser. No. 76,110, filed Sept. 28, 1970, entitled WINDING METHOD OF PRODUCING A LOW FRICTION SURFACE, now abandoned. Reference should also be made to my co-pending application Ser. No. 316,844, filed Dec. 20, 1972.

FIELD OF INVENTION

This invention relates to the treatment of low friction thread to render it bondable and to the coating of the thread with a bonding resin so that the thread is conditioned for subsequent use in the manufacture of low friction surfaces on structural bearing elements and related uses.

BACKGROUND OF THE INVENTION

In the aforesaid applications I have disclosed methods of making bearing structures wherein a bondable and resin impregnated low friction thread is wound onto a structural bearing element and the resin cured to form a low friction surface on the element. In the present application I amplify upon the treatment of the thread preparatory to winding it upon the structural bearing element. This method of treatment of the thread is not restricted to the preparation of low friction thread for use only in the manufacture of bearings, or bearings of the kind illustrated in the aforesaid applications, but is also applicable to the treatment of thread for use in the manufacture of related products as, for example, are disclosed in my co-pending applications Ser. No. 332,419, entitled LOW FRICTION SEAL, filed Feb. 14, 1973, now U.S. Pat. No. 3,841,644, and Ser. No. 321,566, entitled BUSHING AND METHOD OF MAKING SAME, filed Jan. 8, 1973.

Heretofore I have disclosed in my U.S. Pats. Re.24765 and Nos. 3,037,893; 2,885,248 and 3,094,376, BEARING STRUCTURES AND METHODS OF MAKING THE SAME, wherein low friction threads are woven with bondable threads into a cloth, and the cloth is bonded to a structural bearing element to form a low friction surface thereon. While bearings thus formed have enjoyed substantial commercial success, there are certain problems in the use of the cloth, among which is the difficulty in coating the same with the proper amount of bonding resin. The interstices between the warp and woof of the cloth as well as the interstices in the thread itself take up (or sometimes do not adequately take up) the resin during the coating of the cloth which readily leads to a variable cloth-to-resin ration that is difficult to control. In the absence of close control of the cloth-to-resin ratio, bearings made with the cloth exhibit undesirable variations in both thickness, wearability and the bond of the cloth to the structural bearing element to which the cloth is secured.

The aforementioned problems inherent in the use of the cloth, as well as certain other problems, are obviated by the method of making bearings disclosed in my aforesaid pending applications. One of the reasons for this is that I am able to accurately control the amount of resin in the low friction layer which makes up the bearing surface, or in other words the resin-to-fiber ration. This arises from the fact that instead of resin impregnating the thread in the form of a cloth, I impregnate the thread itself in the form of a strand or yarn, and I am able to accurately control much more reliably the ratio of resin-to-thread.

However, the impregnation of the thread or yarn in strand form is not free of difficulties. Following considerable experimentation I conceived the method herein disclosed which is yielding satisfactory results.

SUMMARY OF INVENTION

I have discovered that accurately controllable resin impregnation and cross-sectional shaping of the thread and B-stage curing of the resin can be obtained by leading the thread, or yarn, lengthwise as a continuously moving strand into a resin bath whose resin-to-solvent ratio and viscosity are carefully controlled. In the bath the thread passes between nip rolls where the thread is squeezed and released to cause the resin to be forced and drawn into the body of the thread between the fibers thereof to fill the thread and intimately coat the fibers. From the nip rolls the thread is led to shaping rolls immersed in the resin bath where the impregnated thread is re-shaped and sized following the squeezing action of the nip rolls. From the shaping rolls the thread is led vertically out of the bath and through a B-staging heater. Beyond the heater and at a point where the resin is in the B-stage condition, the thread direction may be altered for winding into spools for subsequent use in the manufacture of bearings and the like. There is no physical contact with the thread between the time it leaves the bath and the point at which the resin is cured to the B-stage.

BRIEF DESCRIPTION OF THE PREFERRED EMBODIMENT

Figure 1:
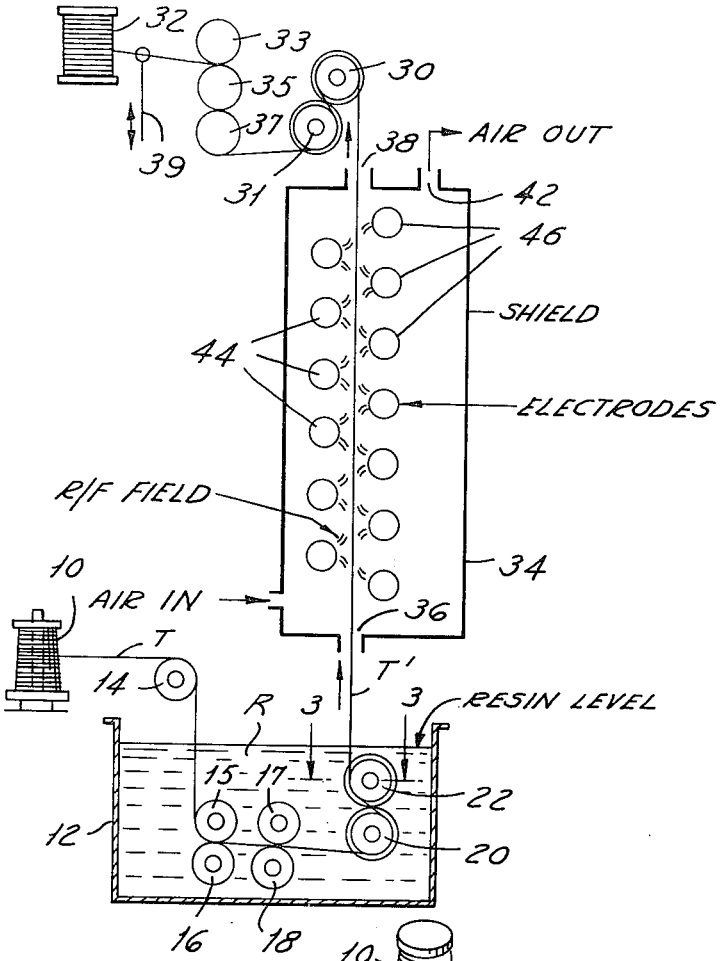
FIG. 1 is a schematic side elevation of apparatus for carrying out the method.

The first step in the preparation of the low friction thread to render it usable in the method of making bearing structures as disclosed in my companion applications hereinabove mentioned, is to treat it so that the thread has a bondable structure, viz. it may be bonded to itself and to a substrate. Those skilled in the art are well aware of the difficulty of resin bonding low friction filaments such as Teflon and polyethylene. Two approaches for rendering the thread bondable are disclosed in my applications, Ser. No. 76,110, filed Sept. 28, 1970, and Ser. No. 316,844. First, the bundles of low friction fibers may be intertwined or twisted with bundles of bondable fibers such as Dacron, cotton, nylon or the like, and the resulting composite thread is thereby rendered bondable. The other approach is to vacuum plate a thin layer of silver or other metal, or an oxide, fluoride or sulphide of a metal on the low friction fibers thereby rendering them bondable. The term bondable low friction thread as used herein refers to a thread which has been treated in either of these two fashions, or in any other suitable fashion, to provide a thread structure which can be securely bonded through the use of resins of the character herein described. The thus prepared thread may conveniently be wound into cones or spools illustrated at 10 in FIGS. 1 and 2 of the drawings.

The second phase in preparing the thread is to impregnate it with the bonding resin and shape and size the thread to predetermined configuration. As shown schematically in FIGS. 1 and 2 this involves arranging a plurality of the spools or cones 10 of the bondable thread adjacent a resin bath and leading the thread T laterally off the spools (to prevent twisting) and over a directional grooved roll 14 and into the bath.

The bath is shown schematically as comprising a tank containing the bonding resin R in the A-stage or liquid stage. In this stage the resin normally will comprise resin dissolved or in solution in a solvent which acts as a carrier or vehicle. The concentration of the resin-to-solvent and the viscosity of the bath may be widely varied as desired and as found necessary to provide the proper impregnation and coating of the thread. The particular resin-to-solvent ratio and viscosity will vary in accordance with the particular resin and solvent being employed, the nominal diameter of the bondable thread, the speed with which the thread is moved through the bath, the characteristics desired in the final produce, and other variables which will be appreciated by those skilled in the art. In one typical example, the following were found satisfactory:

Thread: 50–50 composite Teflon (trademark of DuPont for polytetrafluroethylene) and Dacron (trademark of DuPont for a polyester), nominal diameter 0.0135 inches.

Resin: Phenol formaldehyde in an ethyl alcohol solvent having a resin-to-solvent ratio of 1 to 1.

Speed of Thread: 30 feet per minute.

The resin in the bath may comprise any bonding resin suitable for the intended end use, for example, thermosetting resins such as urea formaldehyde, melamine formaldehyde, urethane resins and the like. Where operating temperatures of bearings to be formed using the thread are sufficiently low, thermoplastic resins may be employed.

After entering the bath the thread is led between plural sets of nip rolls 15, 16, 17 and 18 where the thread is alternately squeezed and released to force the resin through the thread to insure full impregnation. While two sets of rolls are shown, any number to effect full impregnation may be employed. The upper roll of each set preferably is steel, such as stainless steel, while the lower roll has a somewhat resilient surface, and for this purpose may be rubber like or rubber-like surfaced.

Figure 3:
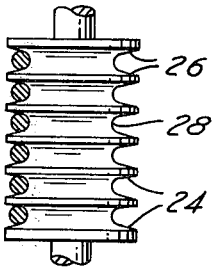
FIG. 3 is a cross-sectional view of a shaping and sizing roll taken along line 3—3 of FIG. 1.

From the nip rolls the thread passes to shaping and sizing rolls 20 and 22. These rolls are provided with relatively deep grooves, as shown in FIG. 3, having an inwardly tapering throat 26 terminating in a semi-circular bottom 28 which is of a determined size. As the thread enters the tapering throat it is reduced gradually to the diameter of the semi-circular bottom of the groove and has a cylindrical shape imparted thereto on opposite sides by the companion or complementary action of the two rolls so that the emerging thread T′ is of essentially cylindrical cross-section of determined diameter. It will be noted that the rolls 20 and 22 are overlapped so that the thread follows a zigzag path whereby the deflection of the thread in its passage through the roll grooves will aid in the sizing and shaping of the thread cross-section. While the bottom 28 of the grooves is shown as semi-circular, it is within the purview of the invention that the bottom could be square to give the thread a square cross-section, or any other desired shape.

Figure 2:
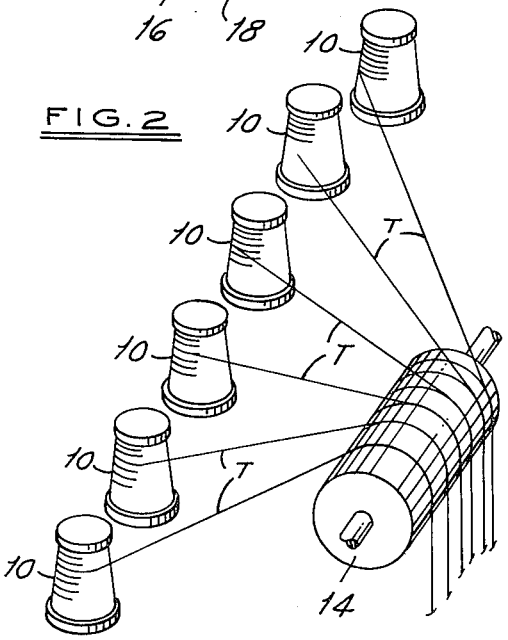
FIG. 2 is a schematic perspective view showing a plurality of thread spools in association with the apparatus of FIG. 1.

Only two rolls 20 and 22 are shown in FIG. 1 for the sizing and shaping function. A greater number may in some instances be found desirable, and the axis of additional sets of rolls may be disposed at 90° or some other suitable angle to the rolls 20 and 22 for further shaping of the thread cross-section shape. The sizing and shaping rolls also serve to further insure full impregnation of the thread by the resin as the re-shaping of the thread following its flattening by the nip rolls will serve to force resin through the interstices around the thread fibers.

From the sizing and shaping rolls the thread is led vertically, as at T′, out of the bath and the resin on the thread is caused to solidify to a non-tacky condition before reaching rollers 30 and 31 from whence it passes to the pulling rolls 33, 35 and 37 and thence to a reciprocating thread guide 39 which winds it uniformly on spools 32 for subsequent use. In the case of thermosetting resins, the resin is cured to the B-stage wherein the resin solvent is driven out and the resin alone remains on the thread in an essentially non-tacky yet incompletely cured condition. This curing or solidifying step is of importance in at least the following respects. First, handling of the coated thread prior to resin solidification will disturb the coating so that it will not be uniform along the thread. Second, it is important in the case of thermosetting resins that all or substantially all the resin solvent be removed so that during subsequent C-stage curing escape of solvent will not disturb the integrity of the resin bond. Third, the sizing and shaping of the thread and the amount of resin coating thereon which is intended to be effected should not be subject to random variables which will disturb control in the final coated thread. I have found that these and other desiderata may be obtained when this step is carried out as illustrated and herein described.

By leading the thread vertically out of the bath directly from the sizing and shaping rolls, runoff of resin is uniformly back down the thread toward the bath as the thread leaves the bath. The amount of this runoff before fixation by the B-staging can be varied by increasing and decreasing thread speed, varying viscosity of the resin bath, and importantly by the character of the curing phase of the method. I have concluded that effective and controllable curing can be best accomplished utilizing a dielectric heater or oven wherein the resin can be quickly heated to the B-staging temperature. This heater is disposed closely adjacent the bath and the thread is led directly thereto and vertically upwardly through the radio frequency field created therein.

The heater is illustrated in FIG. 1. It comprises a closed housing 34 having thread-receiving and emitting openings 36 and 38 and purge air inlet and outlet 40 and 42. Within the housing are two staggered banks of electrodes 44 and 46 between which the thread passes and between which is established a R/F field as indicated in the drawings. The electrodes of bank 44 are similarly polarized and the electrodes of bank 46 are similarly polarized opposite that of bank 44, and the polarity as between the two banks is rapidly and continuously reversed as, for example, at the rate of 25 or more megahertz. The field thus created between the banks will cause rapid oscillation of the polar molecules (dipoles), ions and free electrons in the resin thereby generating heat within the resin itself and causing it to cure. Dielectric heaters of this type are manufactured by Fitchburg Industrial Products of Fitchburg, Mass., and others. Purge air may be supplied by suitable blower means, not shown, which air may be preheated to more readily entrain vapors removed from the resin during curing.

By regulating the distance between the banks of electrodes and/or the electrode voltage and frequency the rate of resin curing may be controlled as is understood in the art. By the time the thread reaches rolls 30 and 31 the resin should be cured to the B-stage. Rolls 30 and 31 may be of a configuration similar to roll 22, with the grooves in the two rolls serving to keep the threads separated as, for example, is shown coming off roll 14 in FIG. 2.

The rolls 30 and 31 serve to shape the thread and size it so that the thread conforms to desired specifications. For this purpose the rolls may be formed of stainless steel and may be heated so that the resin is softened slightly to facilitate the sizing and shaping function. In some instances it may be desirable to effect a "burnishing" action on the thread and in this instance the rolls 30 and 31 may be differentially driven with respect to thread speed so that the burnishing action is carried out as the thread passes through the roll grooves.

The thread passes from roll 31 around roll 37 and around roll 35. Rolls 33 and 35 rest upon roll 37 so that the thread is gripped by the rolls. Rolls 35 and 37 may be driven by suitable electric motor, not shown. In fact, these pulling rolls may provide the sole source of force for pulling the thread off the spools 10 through the bath, the heater and the shaping rolls 30 and 31 so that the thread is maintained under tension from the time it leaves the spools 10 until it passes through the rolls 30 and 31. Suitable take-up drive is provided for the spool 32 to wind the thread thereon after it clears the pulling rolls. A level winder is schematically shown at 39 which reciprocates along the spool 32 to uniformly wind the thread thereon. It will be understood that the number of spools 32 will correspond to the number of spools 10 so that each thread is wound onto its individual spool 32.

It will of course be understood, that by virtue of having cured the resin to the B-stage prior to winding it into the spools 32 that the thus impregnated turns of thread may be readily unwound therefrom for subsequent use in the methods of bearing manufacture disclosed in my aforesaid patent applications.

What is claimed is:

1. The method of making a bondable low friction thread, comprising:

treating lengths of low friction thread to render the thread bondable by providing a thread comprised of low friction filaments intertwined with lengths of bondable filaments, passing the thread lengthwise through a bath of bonding resin to apply the same thereto, leading the thread lengthwise vertically out of the bath and while supporting it in a vertical position curing the resin on the thread to the B-stage, and winding the B-staged thread into spools for subsequent use.

2. The method of claim 1 wherein the low friction filaments are comprised of filaments of polytetrafluroethylene.

3. The method of claim 1 wherein the bondable filaments are filaments selected from a group consisting of a polyester and cotton.

4. The method of claim 1 wherein the resin is a thermosetting resin.

5. The method of claim 1 wherein the resin is a thermosetting resin selected from the group consisting of phenol formaldehyde, ureaformaldehyde, melamine formaldehyde and urethane resins.

6. The invention defined by claim 1 characterized in that following curing of the resin on the thread to the B-stage the thread is sized and shaped in cross section before winding the B-stage thread into spools for subsequent use.

7. The invention defined by claim 6 characterized by burnishing the thread at the time of sizing and shaping the B-stage thread.

8. The method defined by claim 1 characterized by alternately squeezing and releasing the thread within the resin bath as it passes therethrough.

9. The method defined by claim 8 characterized by sizing and shaping the thread within the resin bath following the squeezing and releasing action to reshape and size the cross section of the thread.

10. The invention defined by claim 9 characterized in that the sizing and shaping is carried out by shaping rolls within the resin bath, and the coated thread is led directly from the shaping rolls vertically out of the bath to the dielectric oven without intermediate handling, and curing the resin to the B-stage in the oven.

* * * * *